US012662894B2

(12) United States Patent
Wang et al.

(10) Patent No.: US 12,662,894 B2
(45) Date of Patent: Jun. 23, 2026

(54) SYSTEM AND METHODS FOR WELL HEAD INSTALLATION

(71) Applicant: Cameron International Corporation, Houston, TX (US)

(72) Inventors: Yaou Wang, Sugar Land, TX (US); Haw Keat Lim, Singapore (SG); Yong Wee Lee, Singapore (SG)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 19/206,086

(22) Filed: May 13, 2025

(65) Prior Publication Data

US 2025/0347188 A1 Nov. 13, 2025

Related U.S. Application Data

(60) Provisional application No. 63/646,055, filed on May 13, 2024.

(51) Int. Cl.
*E21B 33/04* (2006.01)
*E21B 47/095* (2012.01)

(52) U.S. Cl.
CPC ..... *E21B 33/04* (2013.01); *E21B 47/095* (2020.05)

(58) Field of Classification Search
CPC ..... E21B 23/02; E21B 33/04; E21B 47/095
See application file for complete search history.

(56) References Cited

U.S. PATENT DOCUMENTS

| | | | | |
|---|---|---|---|---|
| 6,928,399 | B1 * | 8/2005 | Watts, III | G01V 20/00 703/2 |
| 8,826,988 | B2 * | 9/2014 | Gray | E21B 47/09 166/344 |
| 9,051,824 | B2 * | 6/2015 | Broussard | E21B 47/001 |
| 9,869,174 | B2 * | 1/2018 | Szpunar | E21B 47/095 |
| 10,107,061 | B2 * | 10/2018 | Stephens | E21B 41/0085 |
| 10,605,033 | B2 * | 3/2020 | Levert | E21B 34/02 |
| 10,612,366 | B2 * | 4/2020 | Gilleland | E21B 47/092 |
| 10,871,056 | B2 * | 12/2020 | Navar | E21B 47/095 |

(Continued)

FOREIGN PATENT DOCUMENTS

| | | | | |
|---|---|---|---|---|
| CN | 103717829 A | * | 4/2014 | E21B 47/117 |
| GB | 2582889 A | * | 10/2020 | E21B 47/00 |

(Continued)

OTHER PUBLICATIONS

Dr. Ala Hijazi, "Ultrasonic Testing" from "Introduction to Non-Destructive Test", Jan. 9, 2024, Amazon (e-book), pp. 1-36 ( Year: 2024).*

(Continued)

*Primary Examiner* — Jennifer H Gay
(74) *Attorney, Agent, or Firm* — Kyle R. Miiller

(57) ABSTRACT

A system including a casing hanger; a wellhead housing, including a landing shoulder configured to contact the casing hanger during installation of the casing hanger in a wellhead; a transducer disposed on an exterior of the wellhead housing, wherein the transducer is configured to emit an input pulse toward the landing shoulder; and an ultrasonic transmitter coupled to the transducer, wherein the ultrasonic transmitter is configured to detect the input pulse and one or more echo pulses associated with the input pulse.

20 Claims, 5 Drawing Sheets

(56) References Cited

U.S. PATENT DOCUMENTS

| | | | | |
|---|---|---|---|---|
| 11,585,191 | B2 * | 2/2023 | Navar | E21B 47/095 |
| 11,808,141 | B2 * | 11/2023 | Lim | E21B 47/095 |
| 11,834,918 | B2 * | 12/2023 | Mclaughlin | E21B 19/00 |
| 11,905,824 | B2 * | 2/2024 | Gray | E21B 47/095 |
| 2002/0189806 | A1 * | 12/2002 | Davidson | E21B 41/0014 166/336 |
| 2007/0051512 | A1 * | 3/2007 | Markel | E21B 47/092 166/66.5 |
| 2008/0008043 | A1 * | 1/2008 | Jong | E21B 47/017 367/127 |
| 2009/0139724 | A1 * | 6/2009 | Gray | E21B 47/001 166/345 |
| 2011/0083854 | A1 * | 4/2011 | Jennings | E21B 33/035 166/348 |
| 2013/0062056 | A1 * | 3/2013 | Broussard | E21B 47/001 166/250.15 |
| 2013/0283919 | A1 * | 10/2013 | Coonrod | E21B 47/095 73/632 |
| 2016/0305232 | A1 * | 10/2016 | Bird | E21B 47/001 |
| 2016/0319657 | A1 * | 11/2016 | Szpunar | E21B 47/095 |
| 2017/0362910 | A1 * | 12/2017 | Stephens | E21B 33/143 |
| 2018/0163500 | A1 * | 6/2018 | Levert | E21B 33/04 |
| 2018/0163520 | A1 * | 6/2018 | Navar | E21B 43/10 |
| 2019/0169980 | A1 * | 6/2019 | Gilleland | E21B 33/04 |
| 2019/0340322 | A1 * | 11/2019 | Wang | E21B 33/063 |
| 2021/0095548 | A1 * | 4/2021 | Navar | E21B 47/092 |
| 2021/0238937 | A1 * | 8/2021 | McLaughlin | E21B 43/013 |
| 2022/0065100 | A1 * | 3/2022 | Lim | E21B 23/02 |
| 2022/0082015 | A1 * | 3/2022 | Cain | E21B 47/01 |
| 2022/0243585 | A1 * | 8/2022 | Hashim | G01M 3/223 |
| 2023/0008109 | A1 * | 1/2023 | Sneed | E21B 33/04 |
| 2023/0193726 | A1 * | 6/2023 | Navar | E21B 43/10 166/255.1 |
| 2023/0220764 | A1 | 7/2023 | Zhao | |
| 2023/0358133 | A1 * | 11/2023 | Gray | E21B 33/04 |
| 2024/0026777 | A1 * | 1/2024 | Lim | E21B 47/095 |
| 2024/0068360 | A1 * | 2/2024 | Farquharson | E21B 33/03 |
| 2024/0232623 | A1 * | 7/2024 | Loviken | G01S 15/08 |
| 2025/0231393 | A1 * | 7/2025 | Ammar | G06T 7/90 |

FOREIGN PATENT DOCUMENTS

| | | | | |
|---|---|---|---|---|
| WO | WO-2022133596 | A1 * | 6/2022 | E21B 47/092 |
| WO | 2022235481 | A1 | 11/2022 | |

OTHER PUBLICATIONS

Lim, H.K. et al., Novel Deployment of Noninvasive Sensing Technology Improves Wellhead Installation, Paper presented at the SPE Annual Technical Conference and Exhibition, SPE-210296-MS, Sep. 26, 2022, pp. 1-9.

* cited by examiner

SYSTEM AND METHODS FOR WELL HEAD INSTALLATION

CROSS-REFERENCE TO RELATED APPLICATION

The present application is a U.S. Non-Provisional Patent Application claiming the benefit of and priority to U.S. Provisional Patent Application No. 63/646,055, entitled "SYSTEM AND METHOD FOR WELL HEAD INSTALLATION," filed on May 13, 2024, which is incorporated by reference herein.

BACKGROUND

The present disclosure relates generally to a digital position sensing system for wellhead installation. In the oil and gas industry, the wellhead system serves as a barrier preventing the release of hydrocarbons into the environment. Correct installation of the wellhead enabled drilling operations.

Wellhead installations are typically verified using manual methods (markings, visual inspections, and weight indications), which may be subject to human error. Moreover, drilling operators and field service teams continue to face operational challenges when installing wellhead equipment and components such as hangers and packoffs. While some wellheads may be designed to meet the API SPEC6A standard, not all factors can be controlled during the installation of the wellhead system, which may result in false landed indicators, wellhead misalignment, tilting of hanger, and so on.

The common industry practice to mitigate these issues is to use manual techniques and simple visual inspection methods to check installation of the wellhead. Despite these mitigation methods, operational challenges continue to exist in both onshore and offshore environments. Occasionally, during drilling, the wells could face challenges of potential well control issues or operational limitations, which may result in fluid trapped inside the well. As such, it may be difficult to perform the visual inspection for landing verification through the wellhead side outlets during hanger landing. This reduces the mitigation steps and impacts on the confidence level for correct landing, which in some instances may result in costly nonproductive time, production losses caused by delays to the drilling schedule, or negatively impact the safety of a well. Accordingly improved techniques for verifying a hanger landing in a wellhead are needed.

BRIEF DESCRIPTION

In certain embodiments, a system including a casing hanger and a wellhead housing. The wellhead housing including a landing shoulder configured to contact the casing hanger during installation of the casing hanger in a wellhead, a transducer disposed on an exterior of the wellhead housing. The transducer is configured to emit an input pulse toward the landing shoulder. The wellhead housing also including an ultrasonic transmitter coupled to the transducer. The ultrasonic transmitter is configured to detect the input pulse and one or more echo pulses associated with the input pulse.

In certain embodiments, a method for wellhead installation including inserting a casing hanger into a wellhead housing of a wellhead. The casing hanger is configured to land on a landing shoulder of the wellhead housing. The method further including emitting input ultrasonic pulses from a transducer of the wellhead housing. The ultrasonic pulses reflect off one or more internal surfaces of the wellhead housing. The method including detecting the reflected ultrasonic pulses via an ultrasonic transmitter of the wellhead housing, recording the reflected ultrasonic pulses, and determining whether the hanger has landed on the landing shoulder by analyzing the reflected ultrasonic pulses using a binary classification neural network.

In certain embodiments, a system for wellhead installation including a processor, memory accessible to the processor, processor-executable instructions stored in the memory and executable by the processor to instruct the system to emit input ultrasonic pulses from a transducer of a wellhead housing, wherein the wellhead housing is configured to provide a landing shoulder for a casing hanger to contact upon installation. The transducer is configured to emit an input pulse toward the landing shoulder and an ultrasonic transmitter disposed on the wellhead housing is configured to detect the input pulse and one or more echo pulses associated with the input pulse, reflect the input ultrasonic pulses off internal components of the wellhead housing, detect the reflected ultrasonic pulses via the ultrasonic transmitter of the wellhead housing, record the reflected ultrasonic pulses, and determine whether the hanger has landed on the landing shoulder by analyzing the reflected ultrasonic pulses using a binary classification neural network.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
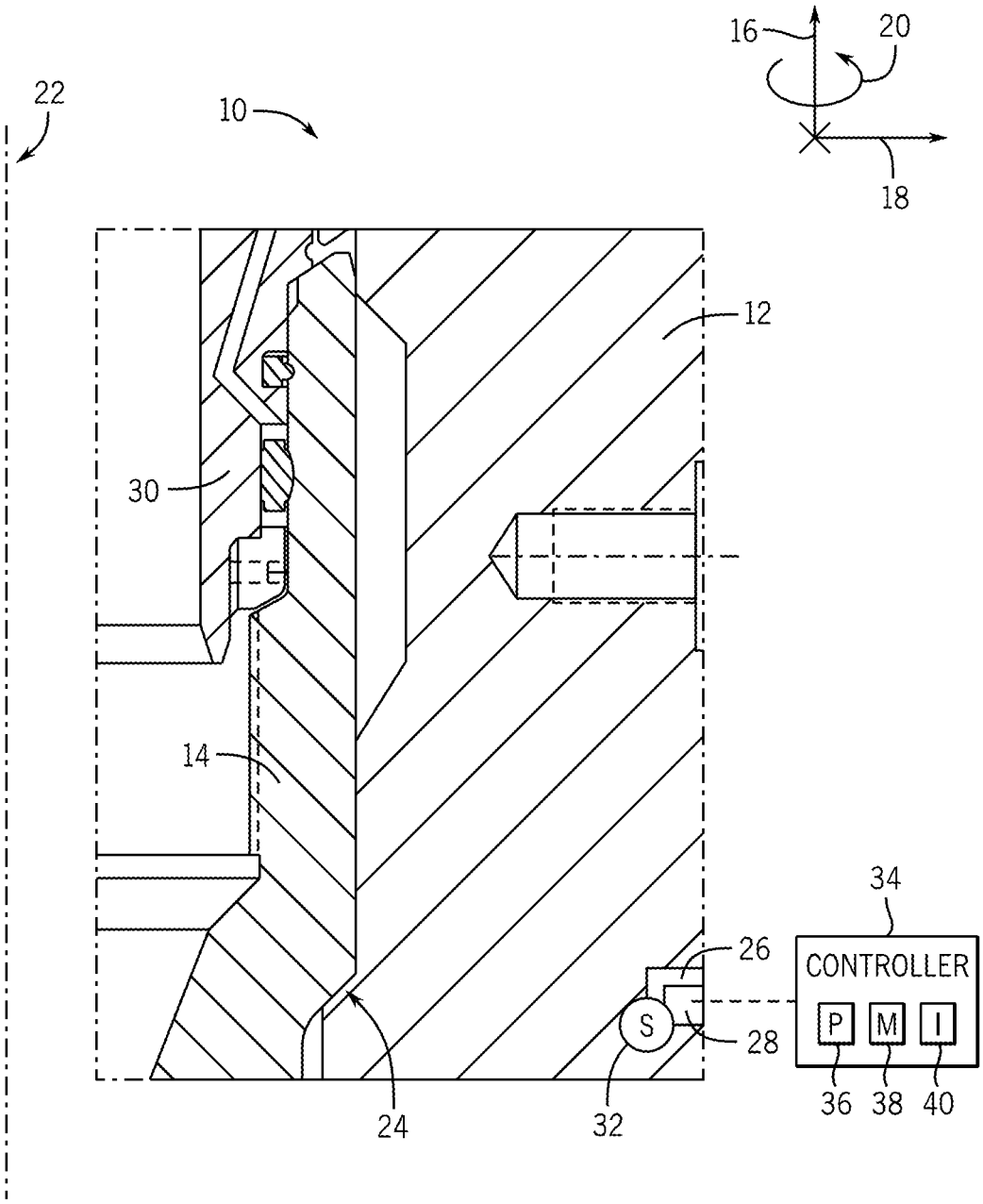
FIG. 1 is a schematic of a wellhead housing with a transducer in a casing hanger, in accordance with the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Drilling operations for the oil and gas industry rely on correct installation of the wellhead. Operators typically verify wellhead installations using manual methods (markings, visual inspections, and weight indications), which may be prone to human error. As such, the present disclosure relates to a digital position sensing system for wellhead installation, which may reduce reliance on human factors and provide assurance that the equipment is properly landed as designed. Specifically, a set of ultrasonic transducers are mechanically mounted on the wellhead housing exterior and configured to operate in a pulse-echo mode. Ultrasonic pulses sent into the housing may reflect against the internal components, providing a unique signature of the internal state of the housing using nonintrusive techniques. A binary classification network trained through machine learning may digitally record and analyze the reflected signals to confirm installation.

Furthermore, the present techniques apply modeling and simulation techniques to mimic the transducer measurement in laboratory testing. To simulate the process, the system may develop a model based on the finite element method (FEM). The simulation may include an ultrasonic signal traveling inside the wellhead, reflecting at a component interface, and reaching the receiver. The system may consider steel and water, as well as the effect of the interface between the steel and water. The ultrasonic input signal may be a Gaussian-modulated sinusoidal pulse. The system may utilize a simplified 2D axisymmetric model of the cylindrical structure to reduce the computational time. The system may analyze the wave pattern based on initial echo, subsequent echo, and the travel time of the reflected wave. The simulation method may provide predictions based on the physical mode to help improve the understanding of the sensing system.

The wellhead installation digital position sensing system may provide real-time feedback to improve the reliability of wellhead equipment installation. The modeling and simulation may provide supplemental training data from the predictions based on the physical mode. The wellhead installation digital position sensing system may reduce the iterative testing performed in a lab to obtain empirical data. The present disclosure may efficiently and accurately assist with verification of the proper installation of internal wellhead components, such as hangers and packoffs.

In one embodiment of the present disclosure, for the wellhead installation digital position sensing solution, an ultrasonic transmitter may have a frequency range of 0.5-2 MHz in the transducers. The transducers emit ultrasonic pulses and record the echo wave reflected from the interior of the wellhead housing. A machine-learning algorithm may differentiate the landings of wellhead components on the basis of the reflected wave received. The machine-learning algorithm is a neural network that takes the ultrasonic echo signals as inputs and assigns a score to each.

Examples in the present disclosure may also be directed to a non-transitory computer-readable medium storing computer-executable instructions and executable by one or more processors of the computer via which the computer-readable medium is accessed. A computer-readable media may be any available media that may be accessed by a computer. By way of example, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers.

Further, software implemented aspects of the subject matter described below may be encoded on some form of program storage medium or implemented over some type of transmission medium. The program storage medium is a non-transitory medium and may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The claimed subject matter is not limited by these aspects of any given implementation.

Turning now to the figures, FIG. 1 illustrates a wellhead installation system 10 including a casing hanger 14 inserted into wellhead housing 12 for installation. For purposes of discussion, reference may be made to an axial direction or axis 16, a radial direction or axis 18, and a circumferential direction or axis 20 relative to a central axis 22 of the wellhead installation system 10. The axial direction 16 may align with the central axis 22 of the wellhead installation system 10 such that the circumferential direction 20 aligns with the general geometry of the borehole in which the wellhead installation system 10 sits.

The landing shoulder 24 is a sloped portion of the casing hanger 14 having a tapered surface, which may act as a landing surface (e.g., the stopping point) of the casing hanger 14 into the wellhead housing 12. Once the casing hanger 14 contacts the landing shoulder 24, the casing hanger 14 is fully settled in the wellhead housing 12, and any other steps in the wellhead installation process may be completed. If a blockage (e.g., debris) prevents the casing hanger 14 from contacting the landing shoulder 24, the casing hanger 14 installation is incomplete. Further, a packoff 30 may be coupled to or located within the casing hanger 14 (e.g., by landing the packoff 30 on a landing shoulder of the casing hanger 14. The packoff may be expanded during installation to create a seal against the casing hanger 14 and/or the wellhead housing 12. To monitor the status of wellhead installation, the wellhead housing 12 may include a transducer 26 and an ultrasonic transmitter 28.

The transducer 26 may be coupled to the exterior of the wellhead housing 12. Further, the ultrasonic transmitter 28 may be coupled to the transducer 26. The transducer 26 and ultrasonic transmitter 28 may be coupled to the wellhead housing 12 at any point along the exterior of the wellhead housing 12 such that the landing shoulder 24 is within input pulse distance of the transducer 26 and ultrasonic transmitter 28.

The transducer 26 is configured to emit an input pulse in the radial direction 18 such that the input pulse hits the landing shoulder 24 of the casing hanger 14. The input pulse may be in the range of 0.5-2 MHz. The input pulse may then hit the casing hanger 14, the landing shoulder 24, and any blockages between the wellhead housing 12 and the landing shoulder 24 and echo back towards the transducer 26. The echo may include one echo, two echoes, three echoes, or four or more echoes based on the input pulse, the material of the wellhead housing 12, the material of the casing hanger 14, any blockages, and the temperature of the materials of the wellhead housing 12 and the casing hanger 14. A sensor 32, coupled to or located adjacent to the ultrasonic transmitter 28, may receive the one or more echoes as the echoes reverberate back in the direction from which the input pulse originated. Once the sensor 32 detects the one or more echoes, the ultrasonic transmitter 28 may transmit a signal indicative of the one or more echoes detected by the sensor 32 to a machine-learning model to perform binary classification to determine if the casing hanger 14 is fully landed. Specifically, the machine-learning model may assess the signal indicative of one or more echoes to determine if the signal aligns with one or more specific signatures which indicate a landed hanger. The machine learning model may run on a controller (e.g., computer) 34 located in the wellhead housing, at the surface of the well, or both. The controller (e.g., computer) 34 has a processor 36, a memory 38, and instructions 40 stored on the memory 38 and executable by the processor 36 to control various components of the wellhead housing, including the ultrasonic transmitter 28, the transducer 26, and the sensor 32. The controller (e.g., computer) 34 is configured to instruct the transducer 26 to emit an input pulse, monitor sensor feedback from the one or more sensors 32, and transmit the signal received at the sensors 32 to the machine-learning model from the ultrasonic transmitter 28. Additionally, the controller (e.g., computer) 34, a remote controller, and/or a remote computer system is configured to analyze the sensor feedback from the sensor 32 using a binary classification neural network or other machine learning algorithm.

Figure 2:
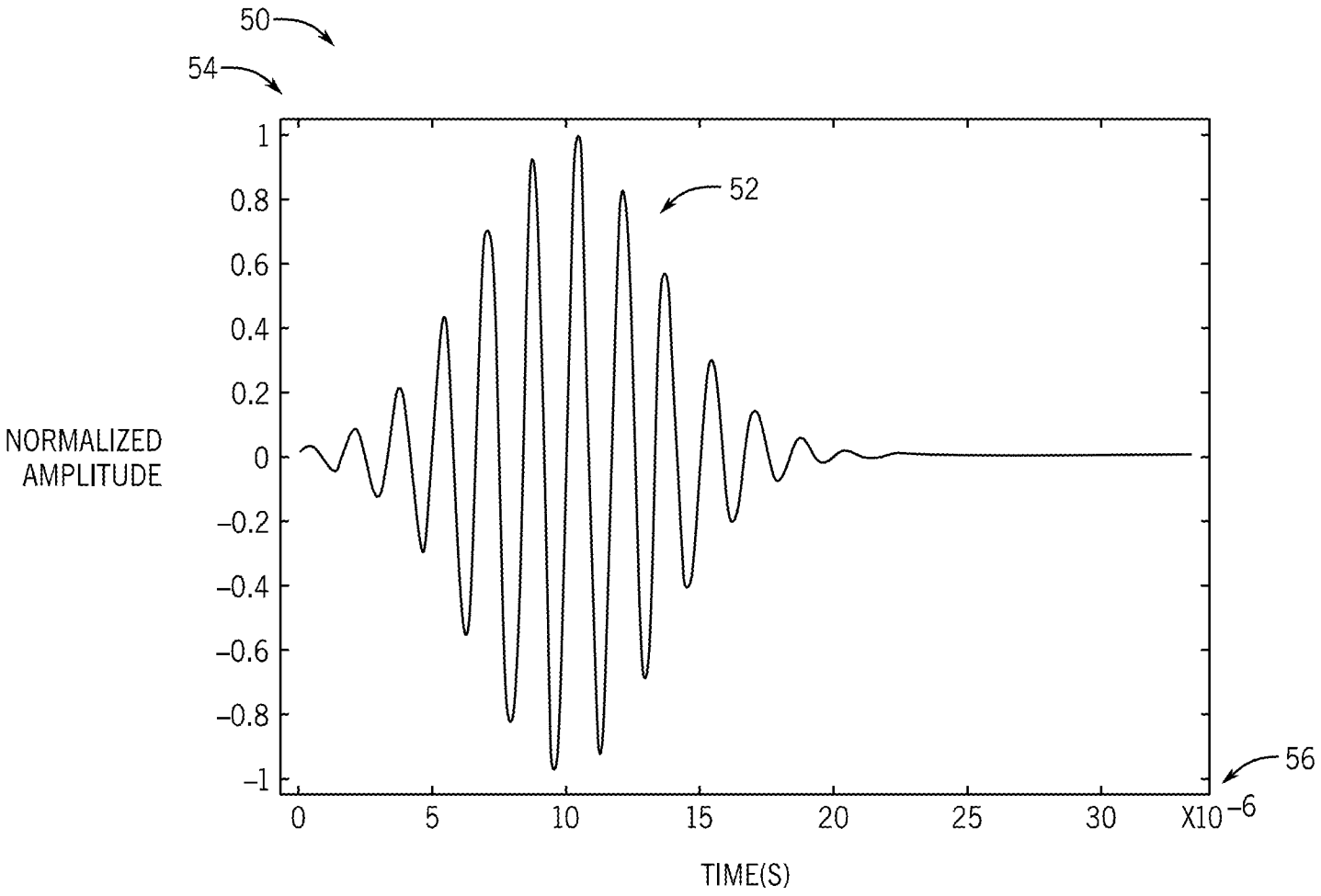
FIG. 2 is a graph illustrating an input pulse generated by the transducer of FIG. 1, in accordance with the present disclosure.

Turning now to FIG. 2, FIG. 2 is a graph 50 illustrating an input pulse 52. The graph 50 illustrates the normalized amplitude 54 (e.g., vertical axis) of the input pulse 52 over time 56 in microseconds (e.g., horizontal axis). The transducer 26 may communicate the input pulse 52 the transducer 26 released to the ultrasonic transmitter 28. The ultrasonic transmitter 28 may then relay the information (e.g., normalized amplitude 54 over time 56) to the machine learning model for the model to reference in the model's calculations. In the illustrated embodiment, the transducer 26 emitted the input pulse 52 from a time of 0 microseconds to a time of 20 microseconds. The normalized amplitude ranged from −1 to 1 around 10 microseconds into the input pulse 52, before tapering to a smaller normalized amplitude range between 10 microseconds and 20 microseconds.

FIG. 3 is an input pulse pressure map 70 that illustrates the path of the input pulse 52 through the wellhead housing 12 towards the casing hanger 14 from the transducer 26. The input pulse 52 starts at the transducer 26 and slowly fans out as the input pulse 52 moves toward the casing hanger 14 in the radial direction 18. The ultrasonic transmitter 28 may communicate information about the input pulse 52 released by the transducer 26 to the machine-learning model.

Figure 3B:
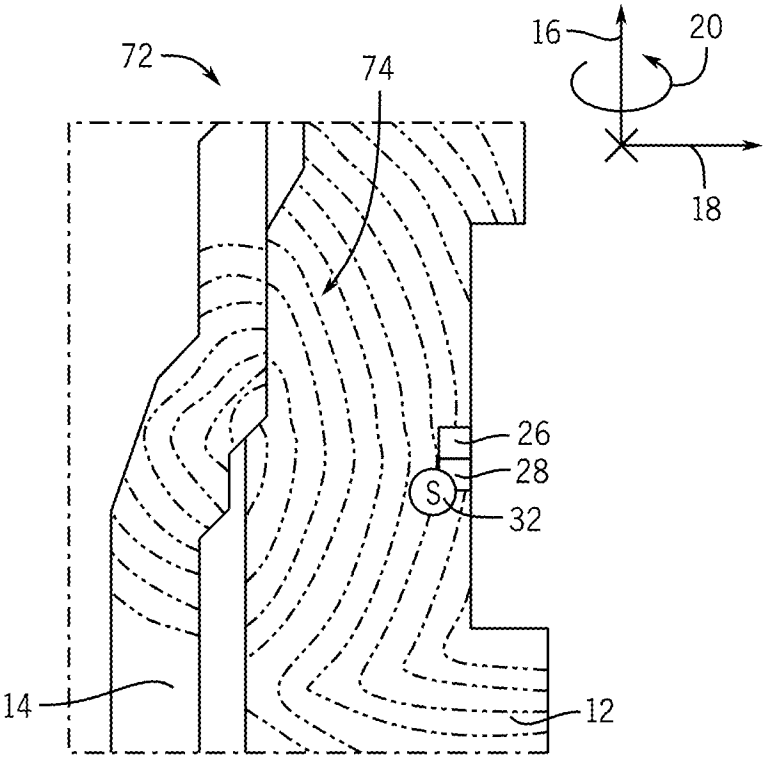
FIG. 3B is an echo wave pressure map associated with the input pulse pressure map of FIG. 3A, in accordance with the present disclosure.
Figure 3A:
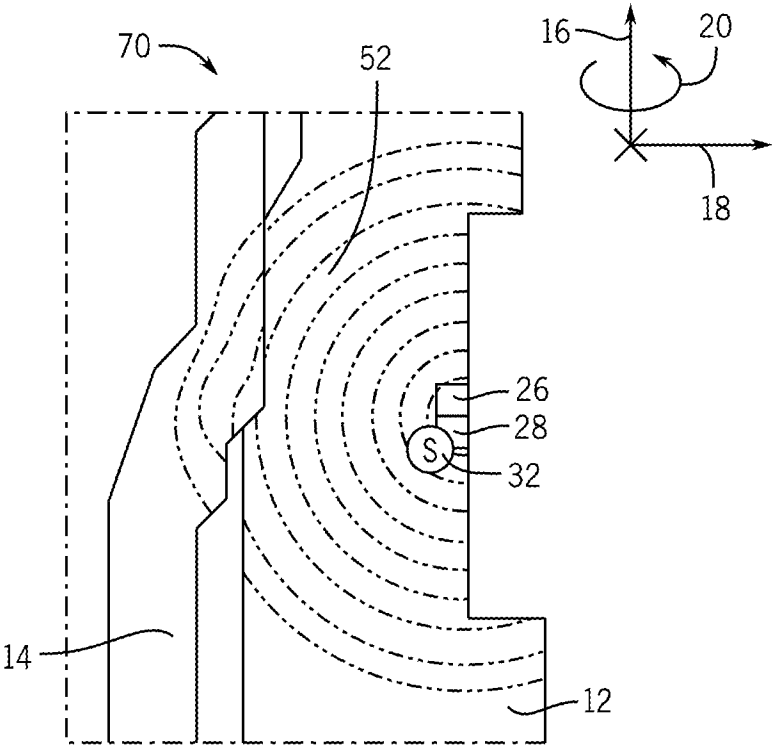
FIG. 3A is an input pulse pressure map of the wellhead housing and the casing hanger of FIG. 1, in accordance with the present disclosure.

FIG. 3B is an echo wave pressure map 72 associated with the input pulse pressure map 70 of FIG. 3A. The echo wave 74 of the illustrated embodiment may be representative of the echo wave 74 caused by the input pulse 52 illustrated in FIG. 3A reflecting off of surfaces within the wellhead. The echo wave 74 may be one echo wave, two echo waves, three echo waves, or four or more echo waves based on the input pulse, the material of the wellhead housing 12, the material of the casing hanger 14, any blockages, and the temperature of the materials of the wellhead housing 12 and the casing hanger 14. These echoes may be plotted near the input pulse 52 on the normalized amplitude over time scale for the machine learning model to determine if the wellhead housing 12 is in direct contact with the landing shoulder 24.

Figure 3C:
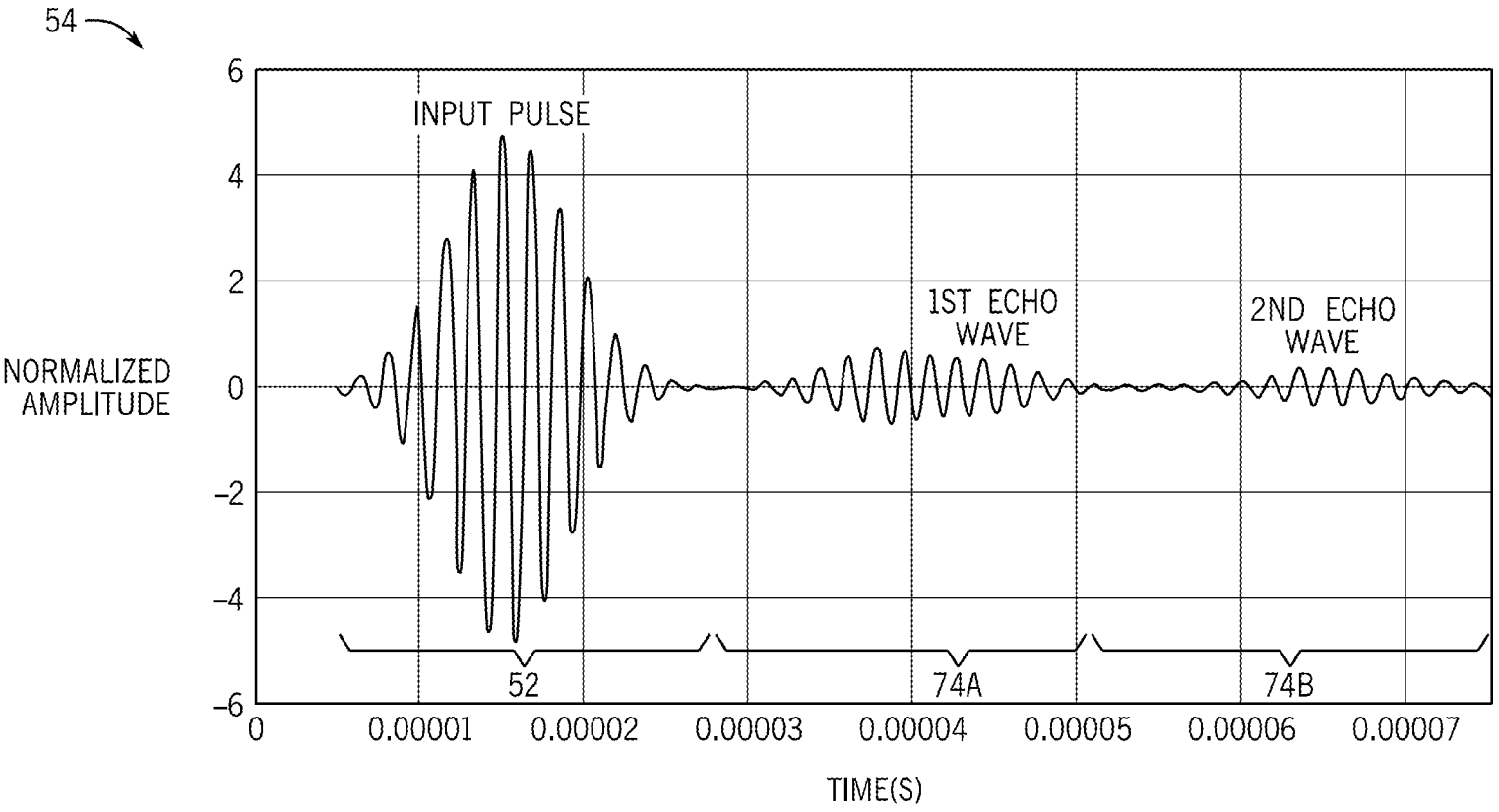
FIG. 3C is a graph illustrating the input pulse and associated echo waves based on the input pulse pressure map and echo wave pressure map of FIGS. 3A-3B, in accordance with the present disclosure.

FIG. 3A and FIG. 3B illustrate the simulation results of an input signal pressure map and an echo wave pressure map. The 2D pressure map results, based on the physical mode, may help the machine learning model understand how the pulse travels and is reflected at the interfaces. FIG. 3C illustrates a prediction of the receiver (e.g., sensor 32) measurement, where the elastic echo wave 74 is measured at the sensor surface and then the average magnitude is communicated to the machine learning model as the prediction. In the illustrated embodiment, the input pulse 52 has a normalized amplitude between approximately −5 and 5 and lasts approximately 25 microseconds. The first echo wave 74A has a smaller amplitude of approximately −1 to 1 and lasts approximately 20 microseconds. The second echo wave 74B has an even smaller normalized amplitude than the first echo wave 74A of approximately −0.5 to 0.5 and lasts approximately 10 microseconds. It should be understood, however, that the input pulse 52 and echo waves 74A, 74B shown in FIG. 3C are merely examples and that embodiments having different input pulses 52 and/or echo waves 74A, 74B are also envisaged.

The predictions may be compared with the laboratory test receiver measurements. Predictions may illustrate similarity in the wave shape, the max peak magnitude, and the bandwidth as test measurement for each echo. Both the prediction and test measurement may also illustrate a similar reduction in the amplitude of the reflected pulse and the travel time from the first echo wave to the second echo wave. A small difference may be observed in the strength of individual peaks. The difference may be within the predefined accuracy expectation, which considers the potential effects of the input signals and the measurement process. For example, the simulation may use ideal analytical input signal, nominal geometry dimensions, and generic material properties. The modeling and simulation method may provide the sensing solution with supplemental training data from the predictions based on the physical mode. Furthermore, the modeling and simulation method reduces the iterative testing in lab to obtain empirical data.

Figure 4:
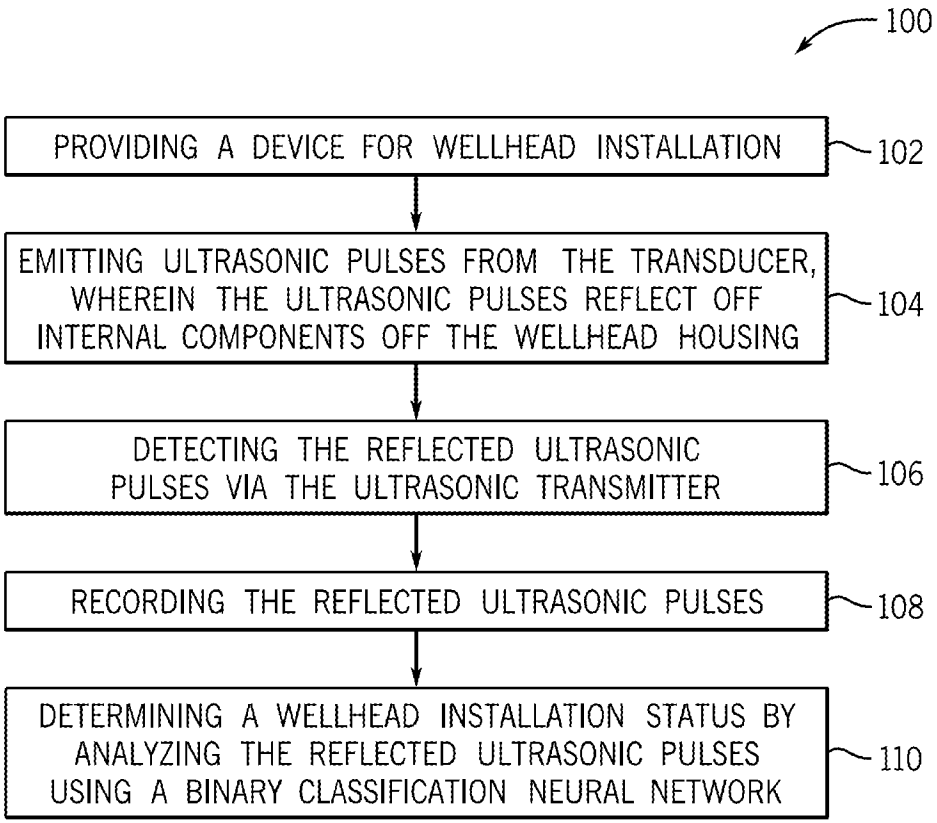
FIG. 4 is a flowchart illustrating a method for determining a wellhead installation status, in accordance with the present disclosure.

FIG. 4 illustrates a process 100 for determining a wellhead component installation status. The process may utilize ultrasonic pulses and the reflection of those pulses back towards a sensor located on the wellhead housing. Further, the method may simulate a landing of a wellhead component to determine if the signals received from the transducer and transmitter indicate a casing hanger, or other wellhead component is in full contact with the wellhead housing, or other wellhead component.

In block 102, the system provides a device for wellhead installation. As described above, this device may include a casing hanger. However, additional embodiments are envisaged in which the disclosed techniques are utilized to determine whether other wellhead components are installed. The wellhead housing may include a transducer to emit ultrasonic pulses, a sensor to sense the reflection of the ultrasonic pulses, and an ultrasonic transmitter to send the received reflection signal to the system for analysis. As described above, the transducer, sensor, and ultrasonic transmitter may all be located on the exterior of the wellhead housing, or other wellhead component.

In block 104, the system emits ultrasonic pulses from the transducer, wherein the ultrasonic pulses reflect off components of the wellhead housing. The rate and frequency of the reflection of the ultrasonic pulse may depend on the materials of the wellhead housing and the casing hanger, the temperature of the wellhead housing and casing hanger, and any blockages in the installation. In some embodiments, blockages may include debris located between the wellhead housing and the casing hanger that prevent proper landing of the casing hanger on the wellhead housing. In some embodiments, a blockage may be anything preventing the casing hanger from contacting the wellhead housing at the landing shoulder. The blockage may be at the landing shoulder or at a different point in the system.

In block 106, the system detects the reflected ultrasonic pulses via the ultrasonic transmitter. As the ultrasonic pulses reflect off the landing shoulder, the sensor and ultrasonic transmitter may detect and relay the reflected signals to the system, respectively. As discussed above, the sensor may be coupled to the ultrasonic transmitter to relay the signals detected by the sensor to the system via the ultrasonic transmitter. Once the system detects the reflected ultrasonic pulses, the system records the reflected ultrasonic pulses in block 108. Specifically, the system may record the reflected ultrasonic pulses for use in its wellhead installation analysis.

In block 110, the system determines a wellhead installation status. The input pulse and the reflected pulses (e.g., echo pulses) may be indicative of a landing status. Specifically, the system may compare the input pulse to the reflected pulses to determine if the internal components (e.g., casing hanger, wellhead housing) are in contact. When the wellhead housing and casing hanger are in contact at the landing shoulder, the reflected pulses (e.g., echo waves) may be different than if the wellhead housing and casing hanger are not in contact or are in a lesser degree of contact at the landing shoulder. As such, the system may utilize the reflected pulses (e.g., echo waves) to determine the landing status of the wellhead housing and casing hanger.

The system may determine the wellhead installation status by analyzing the reflected ultrasonic pulses using a binary classification neural network, which may classify the signal into one of two possible categories. In the described embodiments, the categories may be successfully landed or unsuccessfully landed. An extensive lab testing program may simulate field-deployment conditions. The collected data may then train the machine-learning model to perform binary classification to determine if a fully landed hanger is distinguishable from an offset.

The machine learning algorithm may rely on data collected from extensive laboratory testing. Applying modeling and simulations to mimic the transducer measurement in laboratory testing may validate the feasibility of providing supplemental data through simulation predictions.

In one embodiment of the present disclosure, a finite element method-based simulation model may simulate the ultrasonic test process. The model may consist of wellhead housing, casing hanger, and the fluid inside the wellhead. The model may model parts of wellhead housing and casing hanger as stainless steel, and fluid inside wellhead as water. The system may utilize a simplified 2D axisymmetric model of the cylindrical structure to reduce the computational time. The machine learning algorithm may model water using an acoustic element for wave propagation. The casing hanger landing shoulder may be an ideal contact interface. The model may consider the properties of materials at room temperature Further, the model may use triangular elements, and element size is chosen to be smaller than C_(S,media)/$C_{S,media}/1.5f_0$, where $C_{S,media}$ is the sound wave speed at the media and $f_0$ is the ultrasonic signal frequency.

The model may perform transient analysis using a simulation tool, such as Comsol v5.6 or another suitable simulation tool, which may simulate one transducer operational cycle. One transducer operational cycle may consist of the ultrasonic signal emitting at the sensor surface, traveling inside the wellhead, reflecting at the interface, and returning to the sensor surface. The transducer works based on longitudinal waves. The model presumes the input ultrasonic signal is normal to the housing-sensor interface. The ultrasonic signal is applied as elastic wave to the sensor surface. The model may then measure the reflected wave at the same surface. The signal shape may be a Gaussian-modulated sinusoidal pulse. The model may presume the signal frequency is $f_0$=0.6 MHZ, and the pulse half-width is assumed to be $T_0=6/f_0$.

$$f(t) = \exp\left\{-\left(\frac{t-T_0}{T_0/2}\right)^2 \sin(2\pi f_0 t)\right\} \tag{1}$$

In some embodiments, the wellhead installation status may be successful or unsuccessful. A successful wellhead installation status may include a threshold level of contact between the wellhead housing and the casing hanger at the landing shoulder. The threshold level of contact for a successful wellhead installation status may be greater than 70%, greater than 80%, greater than 90%, or 100% contact between the wellhead housing and the casing hanger at the landing shoulder. The level of contact between the wellhead housing and the casing hanger at the landing shoulder may be determined through the above described analysis and modeling of the reflected signals. Further, the threshold level of contact for a successful landing may be decided by an operator or the system based on the goals of the system and the estimated margin of error in the model and analysis based on temperature changes, natural warps in the wellhead housing and casing hanger, and the like.

An unsuccessful wellhead installation status may include less than a threshold level of contact between the wellhead housing and the casing hanger at the landing shoulder. The threshold level of contact for an unsuccessful wellhead installation status may be less than 10%, less than 20%, less than 30%, less than 40%, greater than 50%, less than 60%, or less than 70% contact between the wellhead housing and the casing hanger at the landing shoulder. The level of contact between the wellhead housing and the casing hanger at the landing shoulder may be determined through the above described analysis and modeling of the reflected signals.

If the wellhead installation system determines the casing hanger is not fully landed, the wellhead installation system may attempt to reinstall the casing hanger into the wellhead housing. In some embodiments, the wellhead installation system may remove the casing hanger partially or completely before reinstalling the casing hanger. In other embodiments, the wellhead installation system may send a fluid (e.g., liquid or gas) to flush out any debris between the casing hanger and wellhead housing. Once a reinstallation attempt is made, the wellhead installation system may send a second input pulse from the transducer to the landing shoulder, which may generate a second set of reflected echo waves. The second set of reflected echo waves may then be detected by the sensors and sent to a computer at the surface or in the wellhead housing to analyze the signals indicative of the second set of echo waves associated with the reinstalled wellhead.

A technical effect of the disclosed embodiments is the ability to detect the landing status of a wellhead and casing without use of laboratory testing. Specifically, the disclosed embodiments describe utilization of input pulses and reflected echo waves to determine if a casing hanger is properly landed in the wellhead housing based on the binary classification neural network's analysis of the input pulses and reflected echo waves.

The subject matter described in detail above may be defined by one or more clauses, as set forth below.

A system including a casing hanger; a wellhead housing, including: a landing shoulder configured to contact the casing hanger during installation of the casing hanger in a wellhead; a transducer disposed on an exterior of the wellhead housing, wherein the transducer is configured to emit an input pulse toward the landing shoulder; and an ultrasonic transmitter coupled to the transducer, wherein the ultrasonic transmitter is configured to detect the input pulse and one or more echo pulses associated with the input pulse.

The system of the preceding clause, wherein the ultrasonic transmitter has a frequency range of 0.5 to 2 Mhz.

The system of any preceding clause, wherein the input pulse and the one or more echo pulses are configured to be analyzed to determine whether the casing hanger has landed on the landing shoulder of the wellhead housing.

The system of the preceding clause, wherein the input pulse and the one or more echo pulses are configured to be analyzed by a binary classification neural network.

A method for wellhead installation including inserting a casing hanger into a wellhead housing of a wellhead. The casing hanger is configured to land on a landing shoulder of the wellhead housing. The method further including emitting input ultrasonic pulses from a transducer of the wellhead housing. The ultrasonic pulses reflect off one or more internal surfaces of the wellhead housing. The method including detecting the reflected ultrasonic pulses via an ultrasonic transmitter of the wellhead housing, recording the reflected ultrasonic pulses, and determining whether the hanger has landed on the landing shoulder by analyzing the reflected ultrasonic pulses using a binary classification neural network.

The method of the preceding clause, wherein the ultrasonic transmitter has a frequency range of 0.5 to 2 Mhz.

The method of any preceding clause, wherein the binary classification neural network is trained using a machine learning algorithm.

The method of any preceding clause, wherein the machine learning algorithm is configured to analyze the reflected ultrasonic pulses recorded to differentiate landings of the internal components.

The method of any preceding clause, wherein the machine learning algorithm is developed using data collected through a finite element method-based simulation model.

The method of any preceding clause, wherein the finite element method-based simulation model simulates ultrasonic test processes.

The method of the preceding clause, wherein the input pulse and the echo pulses are indicative of a landing status.

A system for wellhead installation including a processor, memory accessible to the processor, processor-executable instructions stored in the memory and executable by the processor to instruct the system to emit input ultrasonic pulses from a transducer of a wellhead housing, wherein the wellhead housing is configured to provide a landing shoulder for a casing hanger to contact upon installation. The transducer is configured to emit an input pulse toward the landing shoulder and an ultrasonic transmitter disposed on the wellhead housing is configured to detect the input pulse and one or more echo pulses associated with the input pulse, reflect the input ultrasonic pulses off internal components of the wellhead housing, detect the reflected ultrasonic pulses via the ultrasonic transmitter of the wellhead housing, record the reflected ultrasonic pulses, and determine whether the hanger has landed on the landing shoulder by analyzing the reflected ultrasonic pulses using a binary classification neural network.

The system of the preceding clause, wherein the ultrasonic transmitter has a frequency range of 0.5 to 2 Mhz.

The system of any preceding clause, wherein the binary classification neural network is trained using a machine learning algorithm.

The system of any preceding clause, wherein the machine learning algorithm is configured to differentiate landings of the internal components based on the reflected ultrasonic pulses recorded.

The system of any preceding clause, wherein the machine learning algorithm is developed using data collected through a finite element method-based simulation model.

The system of any preceding clause, wherein the finite element method-based simulation model simulates ultrasonic test processes.

The system of any preceding clause, wherein the input pulse and the echo pulses are indicative of a landing status.

The system of any preceding clause, wherein the transducer is configured to emit a second input pulse and the ultrasonic transmitter is configured to detect the second input pulse and a second one or more echo pulses associated with the second input pulse if the casing hanger has not landed on the landing shoulder of the wellhead housing.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for (perform)ing (a function) . . . " or "step for (perform)ing (a function) . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a casing hanger;

a wellhead housing, comprising:

a landing shoulder configured to contact the casing hanger during installation of the casing hanger in a wellhead;

a transducer disposed on an exterior of the wellhead housing, the transducer being configured to emit an input pulse toward the landing shoulder;

an ultrasonic transmitter coupled to the transducer, the ultrasonic transmitter being configured to detect the input pulse and one or more echo pulses associated with the input pulse; and one or more sensors configured to receive the one or more echo pulses as the one or more echo pulses reverberate back in a direction from which the input pulse originated, the ultrasonic transmitter transmitting a signal indicative of the one or more echo pulses detected by the one or more sensors to a machine-learning model to perform binary classification to determine whether the casing hanger is fully landed, the machine-learning model being trained using data collected through a finite element method-based simulation model, the finite element method-based simulation model being configured to simulate ultrasonic test processes and utilize a simplified 2D axisymmetric model of a cylindrical structure to reduce computational time; and a controller configured to:

control the transducer to emit the input pulse;

monitor sensor feedback from the one or more sensors;

control the ultrasonic transmitter to transmit the signal to the machine-learning model; and analyze the sensor feedback from the one or more sensors using a binary classification neural network.

2. The system of claim 1, wherein the input pulse and the one or more echo pulses are configured to be analyzed to determine whether the casing hanger has landed on the landing shoulder of the wellhead housing.

3. The system of claim 2, wherein the input pulse and the one or more echo pulses are configured to be analyzed by a binary classification neural network.

4. The system of claim 3, wherein, if the casing hanger has not landed on the landing shoulder of the wellhead housing:

the transducer is further configured to emit a second input pulse; and the ultrasonic transmitter is further configured to detect the second input pulse and a second one or more echo pulses associated with the second input pulse.

5. The system of claim 1, wherein the ultrasonic transmitter has a frequency range of 0.5 to 2 Mhz.

6. The system of claim 1, wherein a wellhead installation is successful when a level of contact between the wellhead housing and the casing hanger at the landing shoulder is greater than 70%.

7. The system of claim 1, wherein:

the finite element method-based simulation model comprises model components for the wellhead housing, the casing hanger, and fluid inside the wellhead;

the finite element method-based simulation model is configured to model at least parts of the wellhead housing and the casing hanger as stainless steel; and the finite element method-based simulation model is further configured to model the fluid inside the wellhead as water.

8. The system of claim 1, wherein the machine-learning model is configured to model water in the wellhead using an acoustic element for wave propagation.

9. The system of claim 1, wherein a packoff is coupled to or located within the casing hanger and is expanded during installation to create a seal against the casing hanger and/or the wellhead housing.

10. A method, comprising:

inserting a casing hanger into a wellhead housing of a wellhead, the casing hanger being configured to land on a landing shoulder of the wellhead housing;

emitting input ultrasonic pulses from a transducer of the wellhead housing, the ultrasonic pulses reflecting off one or more internal surfaces of the wellhead housing;

detecting the reflected ultrasonic pulses via an ultrasonic transmitter of the wellhead housing;

receiving, via one or more sensors, the reflected ultrasonic pulses as the reflected ultrasonic pulses reverberate back in a direction from which the input ultrasonic pulses originated, the ultrasonic transmitter transmitting a signal indicative of the reflected ultrasonic pulses detected by the one or more sensors to a machine-learning model to perform binary classification to determine whether the casing hanger is fully landed, the machine-learning model being trained using data collected through a finite element method-based simulation model, the finite element method-based simulation model being configured to simulate ultrasonic test processes and utilize a simplified 2D axisymmetric model of a cylindrical structure to reduce computational time;

recording the reflected ultrasonic pulses; and determining whether the hanger has landed on the landing shoulder by analyzing the reflected ultrasonic pulses using a binary classification neural network.

11. The method of claim 10, wherein the ultrasonic transmitter has a frequency range of 0.5 to 2 Mhz.

12. The method of claim 10, wherein the binary classification neural network is trained using a machine learning algorithm.

13. The method of claim 12, wherein the machine learning algorithm is configured to analyze the reflected ultrasonic pulses recorded to differentiate landings of one or more components of the wellhead, the one or more components of the wellhead including at least the casing hanger.

14. The method of claim 10, wherein the input ultrasonic pulses and the reflected ultrasonic pulses are indicative of a landing status.

15. A system for wellhead installation, the system comprising:

one or more processors;

memory accessible to the one or more processors; and processor-executable instructions stored in the memory and executable by the one or more processors to instruct the system to:

emit input ultrasonic pulses from a transducer of a wellhead housing, the wellhead housing being configured to provide a landing shoulder for a casing hanger to contact upon installation, the transducer being configured to emit an input pulse, among the input ultrasonic pulses, toward the landing shoulder, an ultrasonic transmitter disposed on the wellhead housing being configured to:

detect the input pulse and one or more echo pulses associated with the input pulse;

reflect the input ultrasonic pulses off internal components of the wellhead housing;

detect the reflected ultrasonic pulses via the ultrasonic transmitter of the wellhead housing;

record the reflected ultrasonic pulses; and determine whether the hanger has landed on the landing shoulder by analyzing the reflected ultrasonic pulses using a binary classification neural network, wherein the one or more echo pulses are received via one or more sensors as the one or more echo pulses reverberate back in a direction from which the input pulse originated, the ultrasonic transmitter transmitting a signal indicative of the one or more echo pulses detected by the one or more sensors to a machine-learning model to perform binary classification to determine whether the casing hanger is fully landed, the machine-learning model being trained using data collected through a finite element method-based simulation model, the finite element method-based simulation model being configured to simulate ultrasonic test processes and utilize a simplified 2D axisymmetric model of a cylindrical structure to reduce computational time, and wherein the processor-executable instructions further instruct the system to:

control the transducer to emit the input pulse, monitor sensor feedback from the one or more sensors, control the ultrasonic transmitter to transmit the signal to the machine-learning model, and analyze the sensor feedback from the one or more sensors using a binary classification neural network.

16. The system of claim 15, wherein the ultrasonic transmitter has a frequency range of 0.5 to 2 Mhz.

17. The system of claim 15, wherein the binary classification neural network is trained using a machine learning algorithm.

18. The system of claim 17, wherein the machine learning algorithm is configured to differentiate landings of one or more components of the wellhead based on the reflected ultrasonic pulses recorded.

19. The system of claim 15, wherein the input ultrasonic pulses and the reflected ultrasonic pulses are indicative of a landing status.

20. The system of claim 19, wherein:

the transducer is further configured to emit a second input pulse; and the ultrasonic transmitter is further configured to detect the second input pulse and a second one or more echo pulses associated with the second input pulse if the casing hanger has not landed on the landing shoulder of the wellhead housing.

* * * * *